US008914162B2

(12) United States Patent
Kernwein et al.

(10) Patent No.: US 8,914,162 B2
(45) Date of Patent: Dec. 16, 2014

(54) SYSTEM, METHOD, AND APPARATUS TO DETECT AND REPORT TRACK STRUCTURE DEFECTS

(71) Applicant: Wabtec Holding Corp., Wilmerding, PA (US)

(72) Inventors: Jeffrey D. Kernwein, Cedar Rapids, IA (US); Albert J. Neupaver, Venetia, PA (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 13/795,302

(22) Filed: Mar. 12, 2013

(65) Prior Publication Data

US 2014/0277824 A1 Sep. 18, 2014

(51) Int. Cl.
*B61K 9/08* (2006.01)

(52) U.S. Cl.
CPC ..... *B61K 9/08* (2013.01)
USPC ..... 701/1

(58) Field of Classification Search
CPC ..... G06T 7/44; B61L 23/04; G08G 1/123; B61K 9/08
USPC ..... 701/1
See application file for complete search history.

(56) References Cited

U.S. PATENT DOCUMENTS 5,791,063 A 8/1998 Kesler et al.
5,987,979 A 11/1999 Bryan
6,202,020 B1 * 3/2001 Kyrtsos ..... 701/80
7,164,975 B2 * 1/2007 Bidaud ..... 701/19
7,726,191 B2 * 6/2010 Bestebreurtje ..... 73/614
8,180,590 B2 * 5/2012 Szwilski et al. ..... 702/150
8,294,883 B2 * 10/2012 Holton et al. ..... 356/28.5
8,358,423 B2 * 1/2013 Funken et al. ..... 356/623
8,405,837 B2 * 3/2013 Nagle et al. ..... 356/625
8,412,393 B2 * 4/2013 Anderson et al. ..... 701/19
8,583,313 B2 * 11/2013 Mian ..... 701/28
8,589,256 B2 * 11/2013 Tays et al. ..... 705/28

(Continued)

FOREIGN PATENT DOCUMENTS

EP 1236634 A1 9/2002
JP 2006327551 A 12/2006
WO 2005093157 A1 10/2005

OTHER PUBLICATIONS

Ackroyd, Patrick, et al., "Remote Ride Quality Monitoring of ACELA Train Set Performance," 2002 ASME/IEEE Joint Rail Conference, Washington, DC, Apr. 23-25, 2002, pp. 171-178.*

*Primary Examiner* — Calvin Cheung
*Assistant Examiner* — Allen E Quillen
(74) *Attorney, Agent, or Firm* — The Webb Law Firm

(57) ABSTRACT

A system, method, and apparatus for detecting and reporting track defects while a train is in motion on railway tracks includes at least one defect sensor configured to sense an acceleration of at least a portion of the train; and at least one computer-readable medium. The at least one computer-readable medium comprises program instructions that, when executed by at least one processor, cause the at least one processor to: detect, while the train is in motion on the railway tracks, at least one track defect in the railway tracks based at least partially on the acceleration of the at least a portion of the train; and generate track defect data based at least partially on a location of the train when the at least one track defect is detected.

21 Claims, 6 Drawing Sheets

(56) References Cited

U.S. PATENT DOCUMENTS

| | | | | |
|---|---|---|---|---|
| 8,625,878 | B2 * | 1/2014 | Haas et al. | 382/141 |
| 8,626,459 | B2 * | 1/2014 | Di Scalea et al. | 702/56 |
| 2002/0077733 | A1 | 6/2002 | Bidaud | |
| 2002/0183995 | A1 * | 12/2002 | Veitch et al. | 703/7 |
| 2003/0128030 | A1 * | 7/2003 | Hintze et al. | 324/217 |
| 2004/0105608 | A1 * | 6/2004 | Sloman | 385/12 |
| 2005/0061923 | A1 | 3/2005 | Kane et al. | |
| 2005/0076716 | A1 * | 4/2005 | Turner | 73/579 |
| 2007/0152107 | A1 * | 7/2007 | LeFebvre et al. | 246/169 R |
| 2007/0217670 | A1 * | 9/2007 | Bar-Am | 382/141 |
| 2008/0195265 | A1 * | 8/2008 | Searle et al. | 701/19 |
| 2009/0079560 | A1 * | 3/2009 | Fries et al. | 340/539.22 |
| 2011/0247417 | A1 * | 10/2011 | Oberdoerfer et al. | 73/598 |
| 2011/0278401 | A1 * | 11/2011 | Sheardown et al. | 246/167 A |
| 2012/0062731 | A1 * | 3/2012 | Enomoto et al. | 348/140 |
| 2012/0192756 | A1 * | 8/2012 | Miller et al. | 104/2 |
| 2012/0222579 | A1 * | 9/2012 | Turner et al. | 104/2 |
| 2012/0279308 | A1 * | 11/2012 | Yan et al. | 73/636 |
| 2013/0054158 | A1 * | 2/2013 | Toms | 702/50 |
| 2013/0070083 | A1 * | 3/2013 | Snead | 348/125 |
| 2013/0096739 | A1 * | 4/2013 | Landes et al. | 701/19 |
| 2013/0220019 | A1 * | 8/2013 | Havira et al. | 73/636 |
| 2013/0279743 | A1 * | 10/2013 | Li et al. | 382/103 |
| 2013/0317676 | A1 * | 11/2013 | Cooper et al. | 701/20 |
| 2013/0320153 | A1 * | 12/2013 | Jung et al. | 246/168.1 |
| 2014/0072169 | A1 * | 3/2014 | Haas et al. | 382/103 |

* cited by examiner

Track defect data 605 607 609 601 603

| Magnitude | Location | Date / Time |
|---|---|---|
| MODERATE | 103 yards from milepost 433 | 2012.11.03 / 14:54 |
| SEVERE | 240 yards from milepost 644 | 2012.11.05 / 03:45 |
| SEVERE | 40°26'15.39"N x 79°56'15.93"W | 2012.11.06 / 21:25 |

FIG. 6

SYSTEM, METHOD, AND APPARATUS TO DETECT AND REPORT TRACK STRUCTURE DEFECTS

BACKGROUND OF THE INVENTION

1. Field of the Invention

This invention relates generally to track defect detection and, in particular, a system, method, and apparatus for detecting and reporting track defects in a track network.

2. Description of Related Art

Through regular use and environmental influences, railroad track structures experience wear, damage, and movement of ballasts, ties, and other components that result in track defects, reduced ride quality, and potentially unsafe conditions. Such track defects may cause passenger discomfort and, in some instances, derailments and other undesired effects.

Thus, there is a need for a system, method, and apparatus to detect and report track defects to alert maintenance and repair crews, to initiate speed restriction bulletins, and/or to otherwise log and track the track defects in a track network.

Existing approaches to identifying and locating track defects and/or anomalies are described in U.S. Pat. No. 5,791,063 to Kesler et al., which is directed to a method and apparatus for locating a track defect, and U.S. Pat. No. 5,987,979 to Bryan, which is directed to a method and apparatus for monitoring anomalies in a railway system to predict future track behavior. The Kesler patent compares profiles of track geometry parameters to identify a position of a defect or vehicle along the track, and the Bryan patent predicts defects by analyzing data collected over time. However, the systems in both of the Kesler patent and the Bryan patent specifically rely upon GPS coordinates to provide location information, and the resulting defect or anomaly determinations are limited in accuracy and real-time identification.

SUMMARY OF THE INVENTION

Generally, the present invention provides a system, method, and apparatus for detecting and reporting track defects based at least partially on a vertical, lateral, or angular acceleration, movement, and/or tilt of a train or a portion of a train while the train is traveling over railway tracks.

According to one preferred and non-limiting embodiment of the present invention, provided is a track defect detection system for detecting track defects while a train is in motion on railway tracks, comprising: at least one defect sensor configured to sense an acceleration of at least a portion of the train; and at least one computer-readable medium comprising program instructions that, when executed by at least one processor, cause the at least one processor to: detect, while the train is in motion on the railway tracks, at least one track defect in the railway tracks based at least partially on the acceleration of the at least a portion of the train; and generate track defect data based at least partially on a location of the train when the at least one track defect is detected.

According to another preferred and non-limiting embodiment of the present invention, provided is a system for detecting and reporting track defects while a train travels over railway tracks, comprising a track defect detection device comprising at least one defect sensor; and a locomotive computer in communication with the track defect detection device, the locomotive computer configured to: detect a track defect based at least partially on an acceleration sensed by the at least one defect sensor while the train is in motion; generate track defect data comprising a magnitude and location of the track defect; and communicate at least a portion of the track defect data to a remote server.

According to a further preferred and non-limiting embodiment of the present invention, provided is a method of detecting track defects in railway tracks while a rail vehicle is in motion, comprising: monitoring an acceleration of at least a portion of a rail vehicle while the rail vehicle is in motion; determining, with at least one processer, if a track defect exists on the railway tracks based at least partially on the acceleration; and generating track defect data comprising a location of the track defect and at least one of the following: a magnitude of the track defect, a severity of the track defect, the acceleration, a vertical acceleration, a lateral acceleration, an angular acceleration, a velocity of the rail vehicle, a characteristic of the track defect, a type of the track defect, or any combination thereof.

According to another preferred and non-limiting embodiment of the present invention, provided is a computer program product comprising at least one non-transitory computer-readable medium including program instructions that, when executed by at least one computer including at least one processor, causes the at least one computer to: monitor an acceleration of at least a portion of a rail vehicle while the rail vehicle is in motion; determine if a track defect exists on the railway tracks based at least partially on the acceleration; and generate track defect data comprising a location of the track defect and at least one of the following: a magnitude of the track defect, a severity of the track defect, the acceleration, a vertical acceleration, a lateral acceleration, an angular acceleration, a velocity of the train, a characteristic of the track defect, a type of the track defect, or any combination thereof.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 6 illustrates a track defect data report according to the principles of the present invention.

DESCRIPTION OF THE PREFERRED EMBODIMENTS

Figure 1:
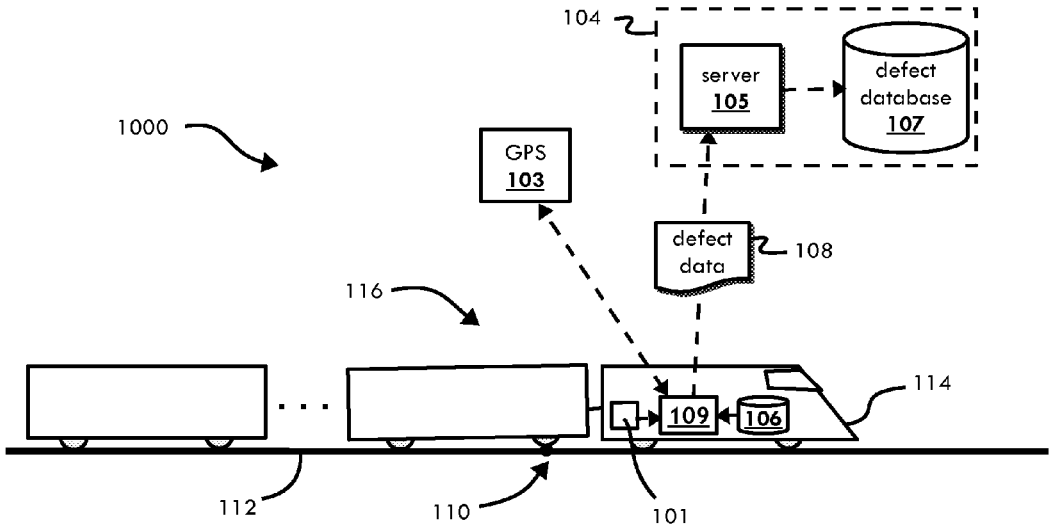
FIG. 1 illustrates a schematic diagram of one embodiment of a system for detecting and reporting track defects according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), and/or the like.

In one preferred and non-limiting embodiment of the present invention, provided is a system, method, and apparatus for detecting and reporting track defects while a train is in motion. Track defects, including but not limited to wear, damage, track obstacles and obstructions, and the movement or shifting of ballasts, ties, and other railroad track structures, are detected based at least partially on a vertical, lateral, or angular acceleration, movement or force, and/or tilt of a train or a portion of a train. It will be appreciated that a track defect may include defects in the track itself, influences from the surrounding area or environment, obstructions, natural occurrences, weather effects, and/or other like conditions that would affect a smooth wheel-to-rail interface. When a track defect is detected, the locomotive computer or other onboard controller generates track defect data by associating a magnitude and/or characteristic of the track defect with the location of the detected track defect in a track network. The track defect data is communicated to a back office system that stores the track defect data. The back office system may then use the track defect data to, for example, alert and dispatch repair crews, monitor track condition trends, issue speed restriction bulletins, and/or the like.

Referring to FIG. 1, a track defect detection system 1000 is shown according to one preferred and non-limiting embodiment. A train 116 is traveling on a track 112 that has a track defect 110. The locomotive 114 of the train 116 includes a locomotive computer 109, such as a train management computer or other onboard controller, track data 106, and a defect sensor 101. The defect sensor 101 is configured to detect and measure acceleration, tilt, movement, and/or force, and may be further configured to detect and measure acceleration or force at any angle or axis. The defect sensor 101 may include, but is not limited to, an accelerometer, gyroscope, pressure/force sensor, and/or other like device. It will be appreciated that the acceleration, movement, tilt, or force detected and measured by the defect sensor 101 may include vertical, lateral, and/or angular acceleration, thrust, or the like, and may be measured and detected at a variety of different angles.

In a preferred and non-limiting embodiment, the track data 106 may specify various features of the track network and, in particular, the track 112 that the train 116 is traveling on and/or is scheduled to travel on. The track data 106 may be stored on any number of data storage devices such as, but not limited to, one or more hard drives, memory devices, and/or the like. The track data 106 may be in the form of any number of data structures and may include, for example, an identifier or name for the track 112 or region for a given location, an associated repair crew, an associated entity, and/or other like features. The track data 106 may identify the track 112 by milepost or other landmarks, authority blocks, longitude and latitude coordinates, and/or other identifying features or attributes of the track 112.

With continued reference to FIG. 1, the locomotive computer 109 is in communication with a back office system 104, including a server computer 105 and track defect database 107. The locomotive computer 109 determines when the train 116 travels over a track defect 110 by comparing a measured defect sensor output with a predetermined threshold. In some non-limiting embodiments, a defect magnitude is calculated based at least in part on the defect sensor output and the velocity of the train 116. In such embodiments, the defect magnitude may be proportional to the defect sensor output, which may include a vertical acceleration, and inversely proportional to the train velocity. For example, a defect sensor 101 output indicating a minor vertical, lateral, or angular acceleration may indicate a track defect 110 at a slow train velocity, but not necessarily at a faster train velocity. It will be appreciated that various other ways to calculate a track defect magnitude based on the defect sensor 101 output may be used.

Still referring to FIG. 1, and according to one preferred and non-limiting embodiment, when a track defect 110 is detected with a magnitude greater than a predetermined threshold, track defect data 108 is generated and communicated to the back office system 104. Alternatively, a sliding scale, range, percentage, and/or the like, may be used to determine if the magnitude of the track defect 110 is significant enough to report. The track defect data 108 indicates a track defect 110 and includes, as an example, a magnitude of the track defect 110 associated with a track location and/or other identifying feature or attribute of the track 112. The track defect data 108 may include data received directly from the defect sensor 101 and/or data processed by the locomotive computer 109. The track defect data 108 may also include at least a portion of the track data 106, or may be generated based at least partially on the track data 106. For example, when a track defect 110 is detected, the track data 106 may be used to map the track defect 110 to a location or an identifiable feature or attribute. The track defect data 108 may then include a magnitude and/or character of the track defect 110 and associated location information including, for example, milepost or other landmark location, authority block location, longitude and latitude coordinates, and/or other like identifying features or attributes.

With continued reference to FIG. 1, in one preferred and non-limiting embodiment, the locomotive computer 109 is in communication with a Global Positioning System (GPS) satellite 103. The locomotive computer 109 may receive real-time location information directly from the GPS satellite 103, or indirectly through an onboard navigation system or other like device or system in communication with the GPS satellite 103. Thus, the geographic coordinates (i.e., longitude and latitude coordinates) may be used to determine the location of the detected track defect 110 in addition to, or in place of, a location based on milepost marker, authority block, or the like. Further, if the defect sensor 101 is mid-train, and not part of the locomotive 114, GPS and/or velocity data received from the head-of-train (HOT) unit, end-of-train (EOT) unit, and/or other computing devices on different railcars may be used to determine the location. For example, if a defect sensor 101 indicates a track defect 110 mid-train, and a GPS device is not located proximate to the defect sensor 101, GPS, velocity, and/or length-of-train data from elsewhere (e.g., the EOT or HOT units, the locomotive computer 109, etc.) may be used to calculate the exact location of the track defect 110 on the track 112.

In some non-limiting embodiments, the track defect data 108 may be in the form of a track defect report, and may include other information such as, but not limited to, a date and time the defect is detected, repair information, railroad information, operator information, trend information and/or the like. The repair information may indicate, for example, an associated repair crew, repair schedule, or scheduled maintenance time. The railroad information may include, for example, an entity in charge of track repairs and/or track maintenance, an identification of the region or track segment, and/or the like. The operator information may include the identification of the train or other entity that detects and reports the track defect 110 to the back office system 104. Trend information may include, for example, historical data for the location of the track defect 110 including past defect magnitudes, past repairs, and/or the like. Additionally, the track defect data 108 may include the vertical, lateral, or angular acceleration, tilt, movement, train velocity, and location, such that the magnitude of the detected track defect 110 can be calculated at a later time by the back office system 104.

Figure 2:
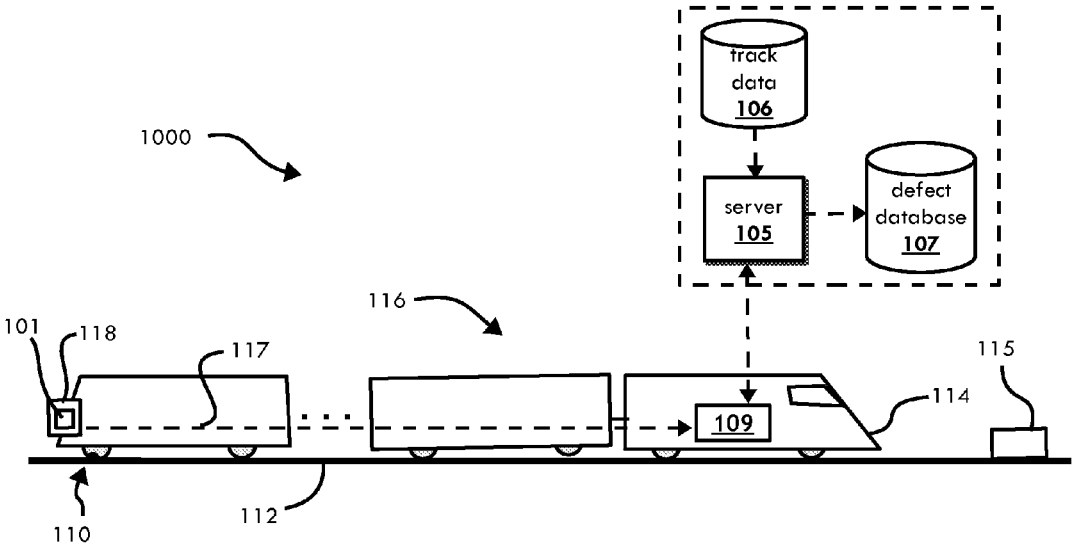
FIG. 2 illustrates a schematic diagram of another embodiment of a system for detecting and reporting track defects according to the principles of the present invention.

Referring now to FIG. 2, a further non-limiting embodiment of a track defect detection system 1000 is shown. In this example, the defect sensor 101 is located on or is otherwise part of an end-of-train device 118 at the rear of the train 116. The end-of-train device 118 is in communication with the locomotive computer 109 via the train line 117, wireless communications system, or other form of communication. Defect sensor output from the defect sensor 101, resulting from the train 116 traveling over a track defect 110, is communicated from the end-of-train device 118 to the locomotive computer 109. The magnitude of the track defect 110 may be determined with a controller of the end-of-train device 118 or the locomotive computer 109. Location information and other identifying data may also be received from wayside equipment 115 associated with the track 112.

Referring to FIGS. 1 and 2, it will be appreciated that, in non-limiting embodiments, the defect sensor 101 may be part of a device adapted to be attached or installed in a locomotive 114, railcar, cab car, end-of-train device 118, head-of-train device, and/or other portions of the train 116. Further, the defect sensor 101 may be part of a device or system already existing on the train such as, for example, a component of a positive train control (PTC) system. For example, the system 1000 may use an accelerometer that is part of a navigation system, the locomotive computer 109, an end-of-train 118 or head-of-train device, a mobile device in communication with the locomotive computer 109, application computing devices on or in a railcar, and/or any other device or system that has capabilities for measuring, sensing, and/or detecting a vertical or lateral acceleration, tilt, or other movement of the train or portion of the train.

With continued reference to FIGS. 1 and 2, the locomotive computer 109 is in communication with the back office system 104 and, in particular, the server computer 105. The server computer 105 may receive the track defect data 108 from the locomotive computer 109 and store it in the track defect database 107. The track defect database 107 may include the track defect data 108 formatted or arranged in any number of data structures. It will further be appreciated that the track defect database 107 may also be located onboard the train 116 and may be part of, for example, an event recording system, the locomotive computer 109, and/or the track data 106.

Figure 3A:
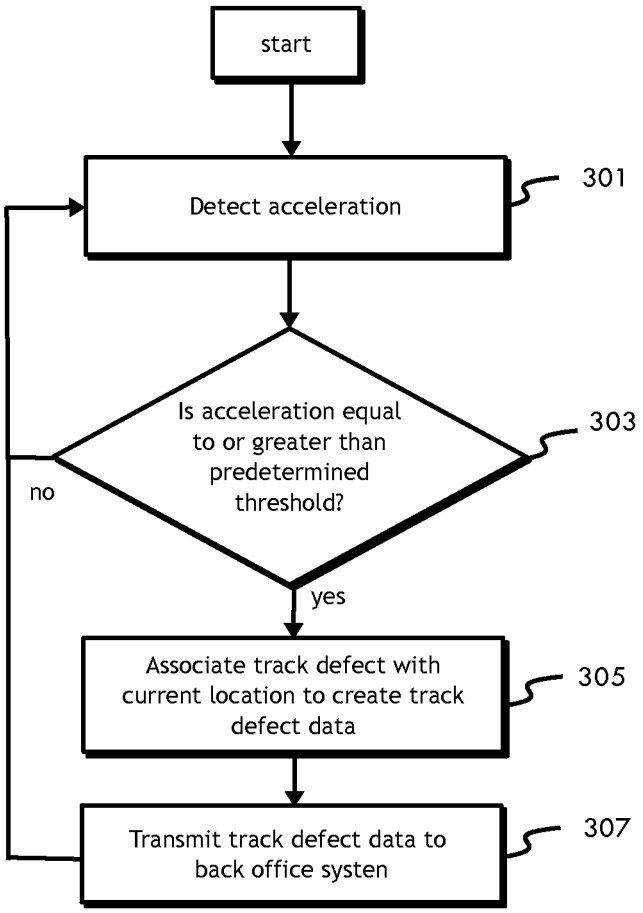
FIGS. 3*a* and 3*b* illustrate step-diagrams for embodiments of a system and method for detecting and reporting track defects according to the principles of the present invention.

Referring now to FIG. 3*a*, a process is shown for detecting and reporting track defects 110 according to one preferred and non-limiting embodiment. The process starts at step 301, during which an acceleration is detected with a defect sensing device 101 while the train is in motion. At step 303, the system 1000 determines whether the acceleration, or a magnitude determined based at least partially on the acceleration, is greater than or equal to a predetermined threshold. If the acceleration and/or the magnitude of the track defect 110 does not equal or exceed the threshold amount, the process starts again at step 301. If the acceleration and/or magnitude of the track defect 110 does equal or surpass the threshold, at step 305, a track defect 110 is identified and associated with the current location of the train 116 to generate track defect data 108. At a next step 307, the track defect data 108 is communicated to the back office system 104 and the process continues to detect subsequent defect sensor outputs at step 301.

Figure 3B:
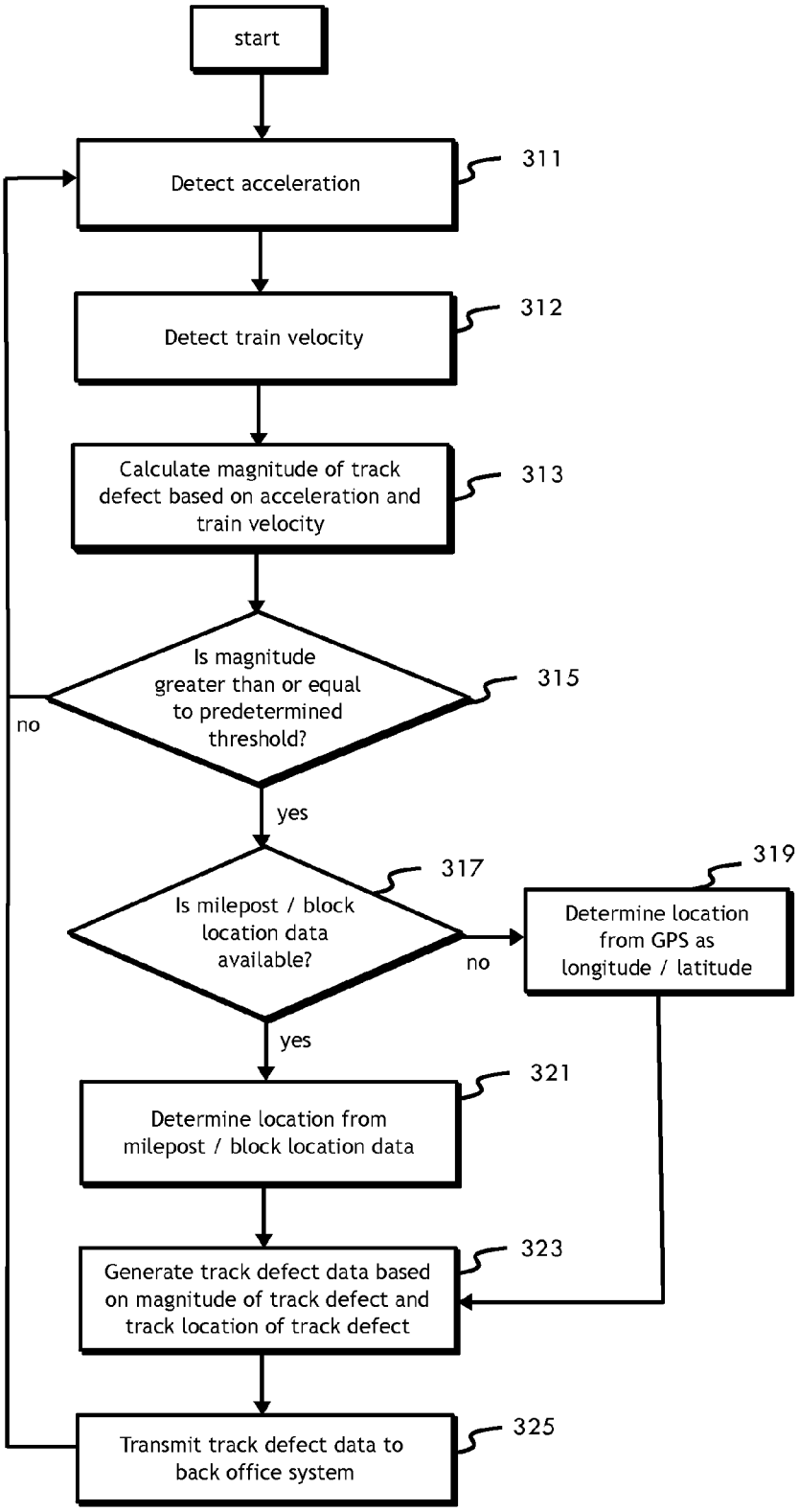

Referring now to FIG. 3*b*, a process is shown for detecting and reporting track defect data according to another preferred and non-limiting embodiment. At a first step 311, an acceleration is detected. The train 116 velocity is detected at a next step 312 based on, for example, a tachometer. Based on the velocity and the acceleration, a magnitude of a track defect 110 is calculated at step 313. At a next step 315, the track defect 110 magnitude is compared to a predetermined threshold and, if the magnitude is greater than or equal to the threshold, the process continues to step 317. If the defect magnitude is below the threshold and therefore not great enough to be identified as a track defect 110, the process starts over at step 311 and continues monitoring the defect sensor output.

Still referring to FIG. 3*b*, at step 317, it is determined if milepost or block location data is available. Milepost or block location data may specifically identify a portion of track 112 or region of a track network based on landmarks or identifiers such as, but not limited to, milepost markers or other landmarks, authority blocks, identified track segments, and/or other features. As an example, a location may be expressed in terms of a distance into a particular authority block or from a given milepost marker. The milepost or block location data may be part of the track data 106 and identified based on a real-time location. If milepost or block location data is available, the method proceeds to step 321 where the location of the track defect 110 is determined relative to the milepost marker, authority block, or other like attribute or feature. If milepost or block location data is not available, at step 319 a longitude and latitude is determined from a Global Positioning System (GPS) or other onboard navigation system. At step 323, track defect data 108 is generated based on the magnitude of the track defect 110 calculated in step 313 and the location data. In some examples, the track defect data 108 may be in the form of a track defect report or other data structure. At step 325, the track defect data 108 is transmitted to the back office system 104.

Figure 4:
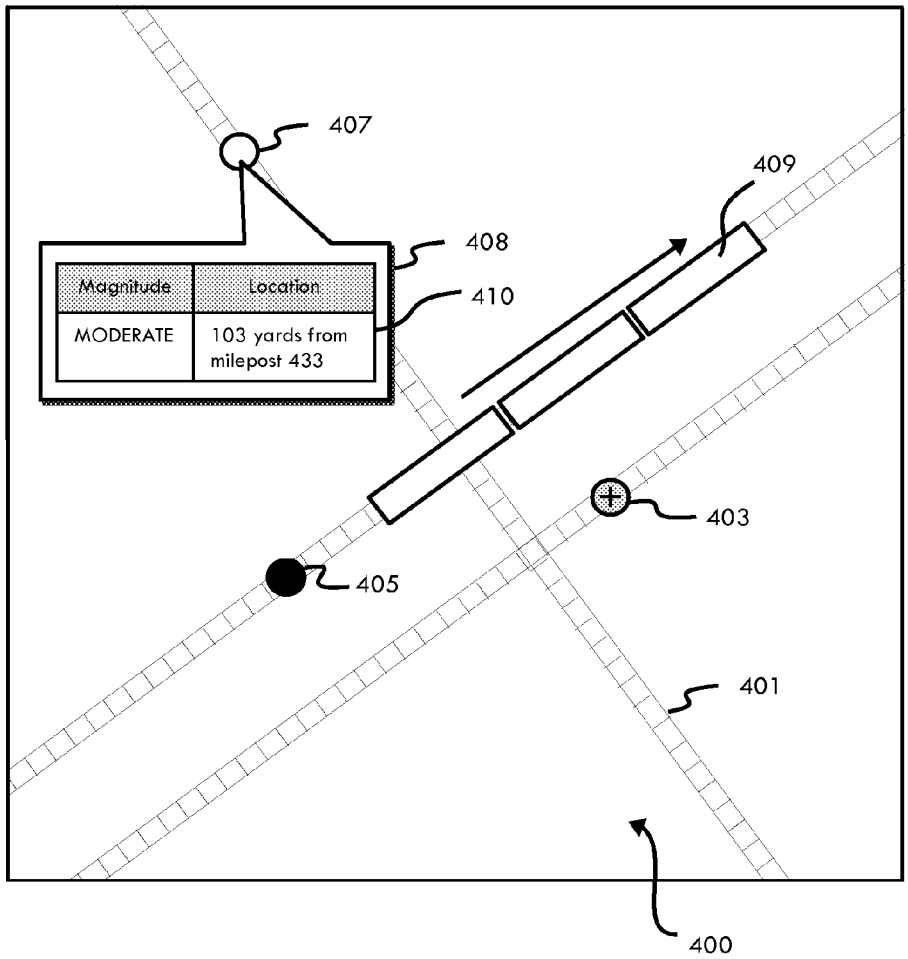
FIG. 4 illustrates an interface including visualized track defect data according to the principles of the present invention.

Referring now to FIG. 4, a track network interface 400 is shown according to one non-limiting embodiment. Track defects 403, 405, 407 are mapped to specific locations of the tracks 401 and are identified by varying graphical symbols, colors, or icons to signify different types and/or magnitudes of track defects. The track network interface 400 is a visualization of at least a portion of the track defect data 108 and/or the track defect database 107. In some non-limiting embodiments, the track network interface 400 may be provided for repair crews, train operators, government agencies, and/or the like. Through the track network interface 400, a user may be able to view and examine the track defects 403, 405, 407 by selecting the corresponding icons. In an embodiment, a selection of a particular track defect 407 displays an information window 408 including track defect data 410. It will be appreciated that various other ways of visualizing and/or interacting with the track defect data 410 may be used, and that the track network interface 400 may be accessed and viewed by a variety of devices and systems such as, for example, a back office system server 105 or other computer, a mobile device, or the locomotive computer 109 (not shown).

Figure 5A:
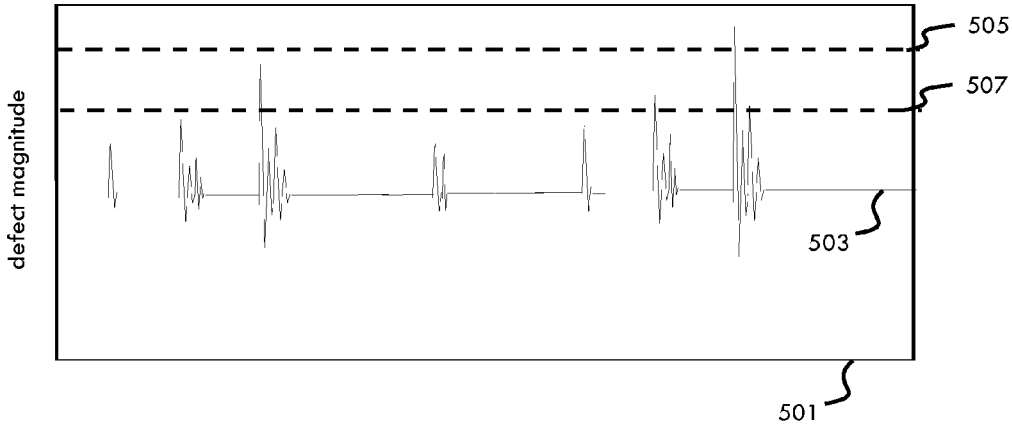
FIG. 5*a* illustrates a defect determination chart of track defect magnitude over time according to the principles of the present invention.

With reference to FIG. 5*a*, a defect determination chart 501 is shown according to one preferred and non-limiting embodiment. The defect determination chart 501 is illustrative of a function or algorithm that determines whether a track defect has been detected. A defect magnitude 503, indicative of the defect sensor output including, for example, a vertical, lateral, or angular acceleration, is shown as a function of time. Threshold levels 505, 507 are associated with predetermined threshold amounts of different types or classifications of track defects. For example, threshold 505 indicates a severe defect and threshold 507 indicates a moderate defect. When the magnitude 503 exceeds or equals the thresholds 505, 507, the track defect 110 is determined to be significant enough to be reported and logged. It will be appreciated that the thresholds may be configured, selected, predetermined, descriptive, based on a sliding scale or percentage, varied based on track 112 or location, and/or the like.

Figure 5B:
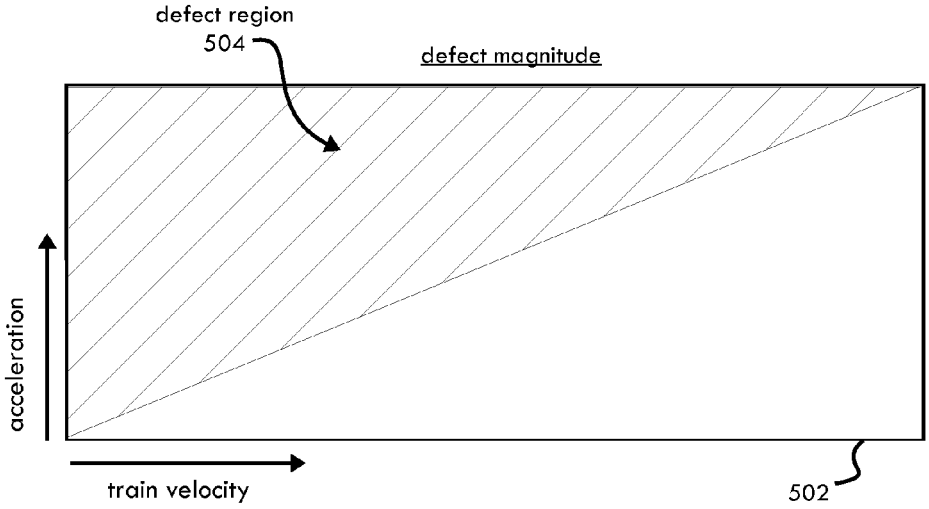
FIG. 5*b* illustrates a defect magnitude chart of vertical acceleration over train velocity according to the principles of the present invention.

Referring now to FIG. 5*b*, a defect magnitude chart 502 is shown according to one preferred and non-limiting embodiment. The defect magnitude chart 502 illustrates acceleration as a function of increasing train velocity. A defect region 504 illustrates corresponding accelerations (e.g., vertical, lateral, and/or angular acceleration) and train velocities that would indicate a track defect 110 significant enough to report (i.e., equal to or greater than a predetermined threshold). The defect magnitude chart 502 is illustrative of a function or algorithm that, based on at least an acceleration and a train velocity, calculates a defect magnitude. Thus, a given acceleration may indicate a track defect 110 at a slow train velocity (i.e., the left side of chart 502), but not at a more rapid velocity (i.e., the right side of the chart 502). In this manner, the faster a train is moving, the greater the acceleration necessary to indicate that a track defect 110 exists.

Referring now to FIG. 6, a track defect report 601 is shown according to one preferred and non-limiting embodiment. The track defect report 601 includes a data structure with track defect data 603 including track defect magnitudes 605 associated with locations 607 of those track defects 110 and a date and time 609 that the track defects 110 were detected. As can be seen, the locations 607 of two of the recorded track defects 110 are measured from milepost landmarks, and the third recorded track defect 110 is measured by longitude and latitude coordinates. The magnitudes 605 may be expressed as a level or classification (e.g., moderate or severe), or as numerical values. As explained herein, different ways for specifying a location may be used based on the data available or determined to be the most accurate when the defect is detected.

In one preferred and non-limiting embodiment, the system 1000 generates and communicates alerts to the back office system 104 when a certain number of track defects 110 have been detected in a particular region or portion of track network. In this manner, repair and maintenance crews can be allocated to repair the defects efficiently. The alerts may be generated based at least partially on the proximity between the track defects 110, the magnitudes of the track defects 110, and/or the like. Alerts may also be generated if, for example, the magnitude of a single track defect 110 is significant enough to pose immediate threat to the safety of other trains.

In one preferred and non-limiting embodiment, the system 1000 may generate or initiate speed restriction bulletins based on detected track defects to help prevent derailments or other accidents. The speed restriction bulletins may be automatically triggered and/or generated by the system 1000 including, for example, the back office system 104 or locomotive computer 109. Because the exact locations of the track defects 110 are known, the speed restriction bulletins can be issued selectively such that they do not cover more portions of track 112 than necessary. Selective speed restriction bulletins minimize the amount of time that a train velocity has to be reduced for problematic track segments. The speed restriction bulletins may be enforced by locomotive speed control units on subsequent trains traversing the track 112 having the detected track defect 110.

The system 1000 may also be configured to detect when a track defect 110 has been repaired or otherwise becomes less problematic, by comparing a defect magnitude detected in a location with a previously recorded magnitude for that location, resulting in the withdrawal of the associated speed restriction bulletin and/or removal of the track defect from the track defect database 107. For example, if a train 116 is traveling over a track 112 that has been previously determined by the system 1000 to have a track defect 110 of a magnitude significant enough to report and log, the acceleration and/or train velocity may be used to calculate a new magnitude of the track defect 110. Therefore, if the track defect 110 has been repaired, or has otherwise become less problematic over time, the train 116 can verify that the track defect 110 does not exist or that the magnitude has decreased by comparing the new magnitude to the previous magnitude. If the new magnitude is negligible or non-existent, or if the new magnitude is less than a predetermined threshold and therefore less than the previous magnitude, the locomotive computer 109 may communicate a message to the back office system 104 to indicate that the track defect 110 has been repaired or has otherwise become insignificant. Multiple detections of a track defect 110 may also allow the back office system 104 to monitor trends in the track defect 110 so that a repair can be made before the magnitude of the track defect 110 reaches a critical level.

In this manner, and according to non-limiting embodiments, track defects 110 may be detected and measured while a train 116 is in motion and associated with the locations of those track defects 110 to form track defect data 108. The track defect data 108 may be compiled in a track defect database 107 and used to efficiently dispatch repair crews, issue selective speed restriction bulletins, monitor trends in track defect 110 magnitudes, and for other purposes. The track defects are detected at least partially on defect sensor output, which may include but is not limited to a vertical, angular, or lateral acceleration of a train 116 or part of a train 116 and, in some examples, a velocity of the train 116.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A track defect detection system for detecting track defects while a train is in motion on railway tracks, comprising:

at least one defect sensor configured to sense an acceleration of at least a portion of the train; and at least one non-transitory computer-readable medium comprising program instructions that, when executed by at least one processor, cause the at least one processor to:

(a) detect, in real-time while the train is in motion on the railway tracks, at least one track defect in the railway tracks based at least partially on the acceleration of the at least a portion of the train as a function of an increasing velocity of the train, such that, the greater the velocity of the train, the greater the acceleration required to detect the at least one track defect; and (b) generate track defect data based at least partially on a location of the train when the at least one track defect is detected; and a back office server computer in communication with the at least one processor, wherein the back office server computer is configured to:

(a) receive, from the at least one processor, at least a portion of the track defect data; and (b) store the at least a portion of the track defect data in a track defect database, wherein the track defect database comprises track locations associated with detected track defects.

2. The track defect detection system of claim 1, wherein the program instructions, when executed by the at least one processor, further cause the at least one processor to receive, from the at least one defect sensor, at least one of the following: vertical acceleration data, lateral acceleration data, angular acceleration data, or any combination thereof.

3. The track defect detection system of claim 1, wherein the track defect detection system further comprises at least one defect detection device, the at least one detection device comprising the at least one defect sensor.

4. The track defect detection system of claim 3, wherein the at least one defect detection device is adapted to be attached to at least one of the following: a locomotive, a railcar, an end-of-train unit, a head-of-train unit, or any combination thereof.

5. The track defect detection system of claim 3, further comprising an onboard computer system, the onboard computer system including the at least one processor, wherein the onboard computer performs at least step (b) of claim 1, and wherein at least one of the onboard computer and the at least one defect detection device performs step (a) of claim 1.

6. The track defect detection system of claim 1, wherein the acceleration comprises a vertical acceleration of the at least a portion of the train.

7. The track defect detection system of claim 1, wherein the at least one track defect is detected by comparing a track defect magnitude to a predetermined threshold, wherein the track defect magnitude is calculated at least partially based on the acceleration and the velocity of the train.

8. The track defect detection system of claim 1, further comprising an onboard navigation system, the onboard navigation system comprising the at least one defect sensor.

9. A system for detecting and reporting track defects while a train travels over railway tracks, comprising:

a track defect detection device comprising at least one defect sensor; and a locomotive computer in communication with the track defect detection device, the locomotive computer configured to:

(a) detect a track defect based at least partially on an acceleration sensed by the at least one defect sensor in real-time while the train is in motion as a function of a velocity of the train such that, the greater the velocity of the train, the greater the acceleration necessary to detect the track defect;

(b) generate track defect data comprising a magnitude and location of the track defect, wherein the location is relative to at least one of the following: a landmark, an authority block, or any combination thereof; and (c) communicate at least a portion of the track defect data to a remote server, wherein the at least a portion of the track defect data is stored in a track defect database.

10. The system of claim 9, further comprising a navigation system, the navigation system comprising the track defect detection device.

11. The system of claim 9, wherein the track defect detection device is adapted to be attached to at least one of the following: a locomotive, a railcar, an end-of-train unit, a head-of-train unit, or any combination thereof.

12. The system of claim 9, wherein the magnitude of the track defect is determined at least partially based on the acceleration and a velocity of the train.

13. The system of claim 9, wherein the location of the track defect comprises at least one of a track region and a longitude and latitude.

14. The system of claim 9, wherein at least one of the locomotive computer and the remote server is configured to generate at least one speed restriction bulletin based at least partially on the location of the track defect.

15. A method of detecting track defects in railway tracks while a rail vehicle is in motion, comprising:

monitoring an acceleration of at least a portion of a rail vehicle while the rail vehicle is in motion;

determining, with at least one processer, if a track defect exists on the railway tracks in real-time while the rail vehicle is in motion, the determination based at least partially on a ratio between the acceleration and a velocity of the rail vehicle, such that, the greater the velocity of the rail vehicle, the greater the acceleration necessary to determine that the track defect exists;

generating track defect data comprising a location of the track defect and at least one of the following: a magnitude of the track defect, a severity of the track defect, the acceleration, a vertical acceleration, a lateral acceleration, an angular acceleration, the velocity of the rail vehicle, a characteristic of the track defect, a type of the track defect, or any combination thereof; and transmitting the track defect data to a back office server, wherein at least a portion of the track defect data is stored in a track defect database.

16. The method of claim 15, wherein the track defect data is generated at least partially by associating, in at least one data structure, the location of the track defect with the at least one of the following: a magnitude of the track defect, a severity of the track defect, the acceleration, a vertical acceleration, a lateral acceleration, an angular acceleration, a velocity of the rail vehicle, a characteristic of the track defect, a type of the track defect, or any combination thereof.

17. The method of claim 15, further comprising generating a speed restriction bulletin for at least the location of the track defect.

18. The method of claim 15, further comprising transmitting, to the back office system, a repair request for the track defect.

19. The method of claim 15, wherein the acceleration comprises a vertical acceleration, and wherein the track defect is determined to exist based at least partially on a ratio of the vertical acceleration to the velocity of the rail vehicle.

20. A computer program product comprising at least one non-transitory computer-readable medium including program instructions that, when executed by at least one computer including at least one processor, causes the at least one computer to:

monitor an acceleration of at least a portion of a train while the train is in motion; determine, in real-time while the train is in motion, if a track defect exists on the railway tracks based at least partially on the acceleration and a velocity of the train, wherein the track defect is determined to exist based at least partially on the acceleration of the rail vehicle as a function of an increasing velocity of the rail vehicle;

generate track defect data comprising a location of the track defect and at least one of the following: a magnitude of the track defect, a severity of the track defect, the acceleration, a vertical acceleration, a lateral acceleration, an angular acceleration, a velocity of the train, a characteristic of the track defect, a type of the track defect, or any combination thereof; and transmit at least a portion of the track defect data to a back office server, wherein the at least a portion of the track defect data is stored in a track defect database.

21. The computer program product of claim 20, wherein the track defect is determined to exist based at least partially on an inverse relationship between the acceleration and the velocity of the rail vehicle.

* * * * *